United States Patent [19]

Christian

[11] Patent Number: 4,773,173

[45] Date of Patent: Sep. 27, 1988

[54] PICTURE FRAME

[76] Inventor: George T. Christian, 3112 Moore St., San Diego, Calif. 92110

[21] Appl. No.: 863,781

[22] Filed: May 16, 1986

[51] Int. Cl.[4] ..... A47B 97/04

[52] U.S. Cl. ..... 40/152.1; 248/459; 248/174

[58] Field of Search ..... 40/152.1, 155; 248/459, 248/152, 174

[56] References Cited

U.S. PATENT DOCUMENTS

| | | | |
|---|---|---|---|
| 1,391,479 | 9/1921 | Kazanjian | 248/174 |
| 1,594,848 | 8/1926 | Partens | 248/174 |
| 1,717,456 | 6/1929 | Lasher, Jr. | 248/174 |
| 2,324,027 | 7/1943 | Rosenberg et al. | 248/459 |
| 2,354,102 | 7/1944 | Brunner | 248/174 |
| 2,409,814 | 10/1946 | Vargish | 40/152.1 |
| 2,443,645 | 6/1948 | Turan | 40/152.1 |
| 2,466,599 | 4/1949 | Larkin | 248/459 |
| 2,480,918 | 9/1949 | Goldman | 40/152.1 |
| 2,519,183 | 8/1950 | Greenspon | 40/152.1 |
| 2,833,070 | 5/1958 | Goldman | 40/152.1 |
| 2,880,534 | 4/1959 | Lund | 40/152.1 |
| 4,582,286 | 4/1986 | Mancuso | 40/152.1 |

*Primary Examiner*—David A. Scherbel
*Assistant Examiner*—Caroline D. Dennison
*Attorney, Agent, or Firm*—Ralph S. Branscomb

[57] ABSTRACT

A picture frame is defined from a single stamping of preferably clear plastic sheet material wherein the sheet is stamped into a front face with a pair of rearwardly bending sidewings, and a base consisting of a horizontally extended bottom plane and an upwardly, forwardly extended brace plane, the upper tips of the brace plane defining inwardly-directed pegs which engage holes in tabs on the sidewings to hold the sidewings back and to hold the base in its supporting configuration. When folded into this configuration, the material of which the frame is preferably made exhibits sufficient memory and tension to hold the unit tautly together, and the rearwardly bent and held sidewings define tracks or slots for the insertion of a photograph or the like from the top.

3 Claims, 1 Drawing Sheet

PICTURE FRAME

BACKGROUND OF THE INVENTION

There is a virtually infinite variety of picture frames on the market. The standard picture frame, at least the kind that is of the standup desktop variety, consists of a piece of cardboard with a back-folding foot or tab which, when folded rearwardly, supports the picture in its upright orientation. The forward panel is then covered with a facing sheet of glass, and a frame of metal or the like surrounds the periphery of both the glass and the facing panel, with a picture sandwiched in between. This type of frame, and a similar frame but absent the glass, pervade the market.

There are other types of frame utilizing a curved, sheetplastic front with tracks defined behind the curved front to receive a photograph when slid in from the top. The plastic of these types of frames is molded and defines an attractive knickknack, with the photograph being the central feature, but perhaps not the most eye-catching part of the entire array.

In addition, in recent years, an array of multi-photo-framing structures have become popular. One of these is simply a conventional frame with matting divided up into numerous internal rectangles and circles and other configurations behind which conventionally sized photographs may be pasted to produce a collage effect.

In another type, a transparent plastic cube or other geometric configuration is provided, each face of which will mount a different photograph.

The frames mentioned above which are plastic are either injection molded or vaccum formed, or formed by some other typical plastic-forming process which is expensive, at least in its start-up mode, and is limiting in the product produced. There is a need, therefore, for an attractive, simple plastic picture frame which can be stamped, rather than molded, and produced in a printing-like process and subsequently folded to its picture frame mode. Such a frame would have the advantages of being extremely simple and cheap to manufacture, and could be shipped and stored in flat stacks at costs well below that which would be required to ship and store bulky aggregations of preshaped frames with their support structure.

SUMMARY OF THE INVENTION

The instant invention fulfills the above-stated need by providing a picture frame that is made by what is basically a printing process. The frame is die-cut from a single transparent planar sheet to define a planar piece which is scored to subdefine it into several panels. One of these, the face panel, passes in front of the photograph and has rearwardly, inwardly directed sidewings which define slots or tracks for the photograph to be slipped in from the top. These sidewings, in turn, are held inwardly and rearwardly by a pair of inwardly directed pegs which engage holes in the sidewings. These pegs are formed in the upper portion of the base structure which holds the face panel in its upright position.

Until folded into its picture frame configuration, the flat sheet is completely planar, separated from adjacent sheets only by a thin, protective sheet of film, so that shipping and storge space occupied is at an absolute minimum.

Additionally, although dies to cut the perimeter of the piece from the sheet stock and to define the score lines for the hinges are not particularly cheap, nonetheless they are much cheaper than comparable injection or vacuum forming molds, and the production process, running as it does much like a printing process, is many times faster than injection molding or vacuum forming techniques.

DETAILED DESCRIPTION OF THE PREFERRED EMBODIMENT

Figure 1:
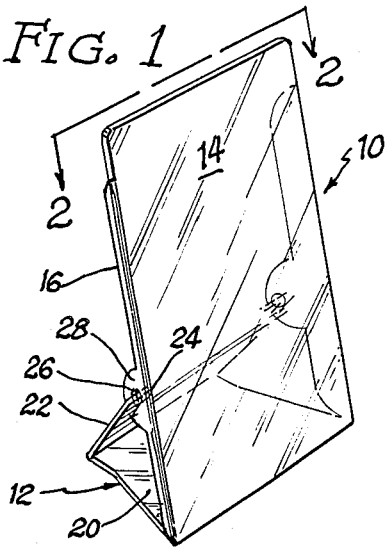
FIG. 1 is a perspective view of the frame in its upright orientation.
Figure 5:
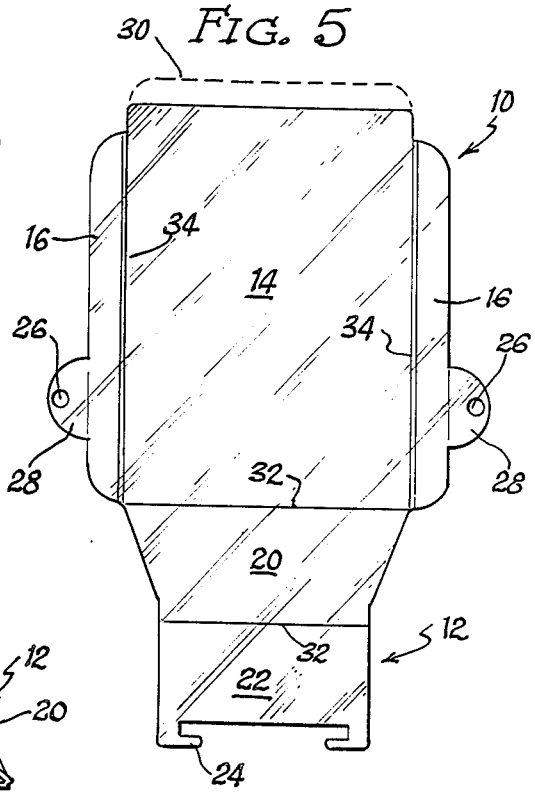
FIG. 5 is a plan view of the piece of sheet stock after it has been cut from the sheet illustrating the optional top flap in phantom.
Figure 2:
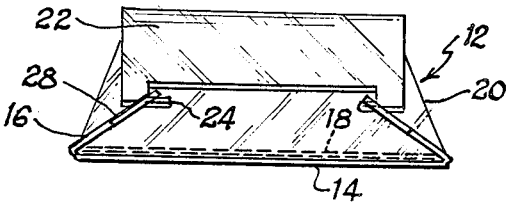
FIG. 2 is a plan view looking down along line 2—2 of FIG. 1.

The frame comprises a face panel 10 and a base member 12. The base and the face panel, as well as all the other sub-parts of the frame, are defined from a single stamping illustrated in FIG. 5. The face panel includes the flat face portion 14, and the sidewings 16 which fold rearwardly in its picture frame mode, best shown in FIG. 2, to define tracks for the photograph 18 which slips immediately behind the face 14 between the wings 16. These wings also serve to reinforce the flat face portion 14 and keep it from curving along the vertical axis.

Figure 6:
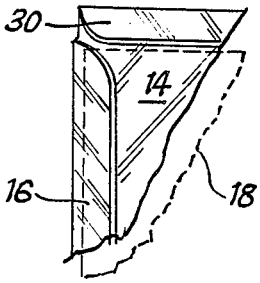
FIG. 6 is a detail illustrating the top rear corner of the frame with the optional flap in place and illustrating how a photocard would be captured; and, FIG. 7 is a vertical section through a top portion of the frame illustrating a photograph as it would rest in place in the frame.
Figure 3:
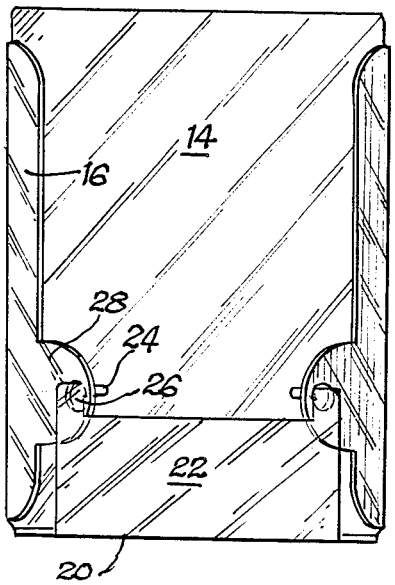
FIG. 3 is a rear elevation view of the frame in its deployed mode.
Figure 4:
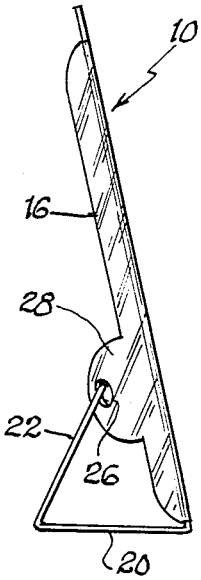
FIG. 4 is a side elevation view of the frame.
Figure 7:
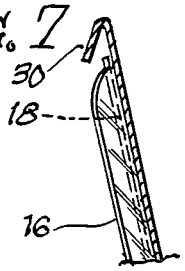

The base portion further breaks down into a flat bottom panel 20, and a brace panel 22 which extends upwardly and forwardly from the rear edge of the bottom panel. The upper edge of the brace panel 22 forms into a pair of opposed, inwardly directed pegs 24 which engage in holes 26 defined in tabs 28 of the face panel 10. Thus, the entire picture frame is formed. There is an optional flap 30 that essentially duplicates a sidewing, but on the top of the face panel 10. This panel, when bent down into the orientation shown in FIG. 6, is partly for aesthetic purposes, becauses it renders the entire side and top perimeter of the face panel identical, and also serves to reinforce the face panel in the lateral direction and tends to hold a photograph in place as suggested in FIGS. 6 and 7.

The panels are defined from the entire piece from score lines 32 formed by a cutting die in the initial cutting process. The sidewings 16 are formed from the main portion of the face panel by double score lines 34. The double score lines enables the sidewings to be bent rearwardly more easily, without flexing the face portion 14 of the face panel. Once bent rearwardly, there is nonetheless a remaining tension that forces the sidewings apart slightly. This tension works well with the tension from the base member 12, which has considerable memory by virtue of the single score lines which define its panels. Together, when assembled, the unit defines a taut, springy configuration with no play or sloppiness in its joints at all. The base member pulls downwardly and outwardly on the tabs of the sidewings, and the sidewings themselves press outwardly to securely engage the pegs defined by the base. Overall, it is a neat, tight, high-tech configuration, that is attractive and economical all at once.

I claim:

1. A frame for holding flat sheets comprising:

(a) a face panel;

(b) a base defining a continuation of said face panel and extending from bottom thereof;

(c) said base panel defining a generally horizontally extendable bottom panel and a brace panel extendable from said bottom panel into engagement with said face panel;

(d) means defining opposed tracks along the side edges of said face panel to hold a photograph in said tracks behind said face panel; and, (e) said face panel having a central portion and a pair of sidewings defining said tracks, said sidewings being bent inwardly and rearwardly to define an acute angle with the central portion of said face panel such that a photo print or other flat sheet can be slide behind said face panel with the edges of said photo print or flat sheet retained in place by said sidewings, with said photo print or other flat sheet being maintained substantially flush against the center portion of said face panel, each of said sidewings defining a hole in it and said brace panel defining a pair of opposed inwardly directed pegs engaging said respective holes to provide a positive engagement against the outwardly expansive force of the inwardly bent sidewings such that said sidewings double as structural strengthening members and retainers, said frame being of a material sufficiently resilient that there remains a memory and an expansive tension in said panels such that said pegs engage said sidewings together under tension.

2. Structure according to claim 1 wherein said brace panel, bottom panel, and face panel are defined with a single score line, and said wings are each defined in said face panel by a pair of closely spaced parallel score lines.

3. Structure according to claim 1 and including a top flap extending from the upper edge of said face panel and foldable rearwardly in similar fashion to said sidewings to retain a photograph behind said face panel and reinforce said face panel.

* * * * *